US007887045B2

(12) United States Patent
Baena, Jr. et al.

(10) Patent No.: US 7,887,045 B2
(45) Date of Patent: Feb. 15, 2011

(54) METHOD FOR DYNAMICALLY LIFTING ELEVATOR PLATFORM OF MEDIA INPUT TRAY DURING ONGOING MEDIA PROCESS

(75) Inventors: Douglas Andagan Baena, Jr., Bunao (PH); William Paul Cook, Lexington, KY (US); Robert Ryan Fresnoza Cruz, Mandaue (PH); Irvin Langit Libres, Cebu (PH); Jake Tia Pia, Dumaguete (PH); Jason Lee Rowe, Richmond, KY (US); Kim Limpahan Balahan, Dumaguete (PH); Stacey Edward Balch, Versailles, KY (US); Daniel Paul Cahill, Verona, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 12/176,155

(22) Filed: Jul. 18, 2008

(65) Prior Publication Data

US 2010/0013143 A1 Jan. 21, 2010

(51) Int. Cl.
*B65H 3/14* (2006.01)

(52) U.S. Cl. ..... 271/152; 271/153; 271/154

(58) Field of Classification Search ..... 271/152, 271/153, 154, 157, 155
See application file for complete search history.

(56) References Cited

U.S. PATENT DOCUMENTS

| | | | | |
|---|---|---|---|---|
| 6,293,539 | B1 * | 9/2001 | Fukatsu et al. | 271/126 |
| 6,908,082 | B2 * | 6/2005 | Dobbertin et al. | 271/152 |
| 2003/0015836 | A1 * | 1/2003 | Westcott et al. | 271/152 |
| 2007/0001369 | A1 | 1/2007 | Murrell et al. | |

* cited by examiner

*Primary Examiner*—Kaitlin S Joerger
(74) *Attorney, Agent, or Firm*—John Victor Pezdek

(57) ABSTRACT

A method for dynamically lifting an elevator includes picking a sheet from a stack to feed to a media process where the stack is on a platform that can be lifted by an elevator, performing the media process, sensing a top of the stack to detect presence or absence of the stack at a media home position, sensing the top of the stack to detect presence or absence of the stack on the platform, sensing the platform to detect its presence or absence at a maximum elevator level, and indexing the stack at least once by lifting the platform through a given distance, during the media process and not during picking a sheet, unless presence of the top of the stack at the media home position is sensed or absence of media sheets on the elevator platform is sensed or presence of the elevator platform at the maximum elevator level is sensed.

20 Claims, 4 Drawing Sheets

| SENSOR 1 | SENSOR 2 | SENSOR 3 | |
|---|---|---|---|
| 1 | 0 | 0 | HOME POSITION |

| SENSOR 1 | SENSOR 2 | SENSOR 3 | |
|---|---|---|---|
| 1 | 1 | 0 | BELOW HOME POSITION |

| SENSOR 1 | SENSOR 2 | SENSOR 3 | |
|---|---|---|---|
| 0 | 1 | 0 | INDEX START |

| SENSOR 1 | SENSOR 2 | SENSOR 3 | |
|---|---|---|---|
| 1 | 1 | 1 | LOW STACK HEIGHT |

| SENSOR 1 | SENSOR 2 | SENSOR 3 | |
|---|---|---|---|
| 0 | 0 | 1 | MEDIA STACK EMPTY |

METHOD FOR DYNAMICALLY LIFTING ELEVATOR PLATFORM OF MEDIA INPUT TRAY DURING ONGOING MEDIA PROCESS

BACKGROUND

1. Field of the Invention

The present invention relates generally to a high capacity media handling device and, more particularly, to a method for dynamically lifting an elevator platform of a media input tray in a media handling device during an ongoing media process.

2. Description of the Related Art

Demand in the market for high capacity media handling devices is increasing due to flexibility of these devices. Different media can be selected by customers for use with these devices. Greater volumes of media can be loaded into these devices. These devices need a media input tray that can efficiently feed a high volume of media. The media input tray utilizes a pick mechanism that feeds media a sheet at a time to a media process, such as printing, copying and the like, and an elevator that lifts a large stack of media sheets so as to place the top of the stack at a pick position relative to the pick mechanism.

The pick position may be at any of a plurality of levels that intersect an inclined surface on a restraint dam of the input tray between the upper and lower ends of the dam. The pick mechanism is able to feed media a sheet at a time most reliably when the top of the stack is at a pick position. Thus, the top of the stack should be maintained at a pick position regardless of how much media is loaded on a platform of the elevator as long as the loaded media does not exceed its specified capacity.

When the stack of media sheets is lifted by the elevator after being loaded onto the elevator platform, there is a maximum upper limit that the top of the stack can reach; it is called the media home position. This limit is the highest pick position. The input tray has a first sensor, such as a photo-interrupter or other electro-mechanical switch, to detect the media home position. When the media sheets are picked one at a time from the stack to supply a media process, such as printing, the level of the top of the stack decreases and potentially could go below the lowest level of the pick position. The main function of the elevator is to return the top of the stack to the media home position before it goes below the lower limit of the pick position which is the same as the lower end of the inclined surface of the dam.

Timing for lifting the stack by the elevator is also important since the stack must not be lifted when the pick mechanism is feeding sheets of media from the stack. Doing both at the same time could introduce adverse forces on the stack since the pick mechanism is pressing downward on the stack as the elevator is lifting the stack upward. This could cause media multi-feeds or damage to the media sheets.

The window for lifting the stack by the elevator to reach the media home position will be smaller if the throughput of the media process is faster. Since throughput is a function of inter-page gap, as provided in this relationship:

$$\text{throughput(pages/min.)}=(\text{process speed}\times 60)/(\text{page length}+\text{inter-page gap}),$$

where: throughput=page out per minute (PPM); process speed=linear sheet speed in the system (mm/s); page length=length of sheet being fed (mm); and inter-page gap=gap between leading sheet and trailing sheet (mm), having a longer inter-page gap will result in a slower throughput assuming that the process speed is made constant.

To achieve the desired inter-page gap during lifting the stack to the media home position, either the lifting must be made faster or the lifting distance or travel made shorter. When the input tray is ready for the next pick page command but the elevator is still lifting, the input tray will detect an error condition since there is a possibility of lifting the platform and picking the media at the same time.

The input tray typically employs one of two approaches to control the operation of the elevator. In the case of the first approach, the input tray uses four sensors. The first sensor, as already mentioned, senses the presence of the top of the stack at the media home position. A second sensor, the same type as the first one, is used to detect if the input tray is already empty. When the second sensor is triggered, there is no need to actuate the elevator to lift the platform since there is no more media sheets stacked on the platform. A third sensor, being the same type as the first two, is used to detect if the stack on the platform is already low. When the third sensor is triggered, the operation of the elevator remains the same.

A fourth sensor, the same type as first three, is used to detect the media level when the stack should be lifted by the elevator. Thus, the fourth sensor is at the elevator turn-on level. This fourth sensor is relatively close to the media home position and thus to the first sensor. Making the media home position and the elevator turn-on level farther apart will delay the next pick page sequence and, in turn, increase the inter-page gap (IPG), thus resulting in a lower throughput. When the elevator turn-on level is detected, by way of example, only approximately three sheets (nominal) of media are fed. The platform will then be lifted by the elevator until the media home position is reached. There are no increases in IPG and delays on the throughput using this first approach. Also, the elevator lifting speed is made constant since the level difference of the elevator turn-on and home position is not varying. However, because the media level difference of home position and elevator turn-on position is small, the leading edge of the media sheet enters via the dam on the same location; hence the rate of deterioration of a wear strip on the dam is high under this first approach.

In the case of the second approach, the input tray utilizes only three sensors. These sensors are the same as first, second and third sensors used in the first approach. The second approach does not use the fourth sensor used in the first approach, that is, to detect the media level when the stack should be lifted by the elevator. Instead, from the media home position, the number of sheets fed by the pick mechanism is counted until a preset maximum count is reached. No additional IPG or throughput delay is introduced. When the maximum count is reached by the input tray, the elevator will lift the platform until the first, or media home position, sensor is attained. However, even though the media level difference of the home position and its start to lift is relatively higher here, it still does not utilize the whole range of the dam for the pick position. The sheets counted before lifting are limited to a certain distance to make sure no delays are introduced in the IPG. Therefore, the speed is made faster to reach the media home position on time. Wear on the dam is still confined to an upper portion of the dam inclined surface.

A third approach to lifting the stack during printing or feeding sheets might be to just stop the media process and to continue feeding only once the media home position is reached. With this approach, the delay between sheets will depend on the distance for lifting the stack or by increasing the lifting speed. Maximizing the pick position would mean long travel for lifting the stack.

Thus, there is still a need for an innovation that will coordinate lifting of the media stack by the elevator with other operations so as to increase productivity without imposing any adverse impacts such as concentrated wear on the dam inclined surface.

SUMMARY OF THE INVENTION

The present invention meets this need by providing an innovation that introduces dynamic lifting the elevator platform of the media input tray in a media handling device. The innovation involves operating the elevator to lift the platform through segments or increments during an ongoing media process, but not during picking one sheet at a time, until the top of the stack reaches the media home position or the elevator reaches its maximum level. Indexing the stack will not introduce delays in the media feed throughput as it will not add delays in the inter-page gaps between sheets. There is no need to stop the ongoing media process to elevate the media stack. This innovation will spread the pick positions along the inclined surface of the dam so as to reduce the concentration of wear at any one region thereon.

Accordingly, in an aspect of the present invention, a method for dynamically lifting an elevator platform of a media input tray during an ongoing media process includes picking a sheet at a time from a top of a stack of media sheets using a pick mechanism to feed to a media process with the top of the stack initially at a media home position and the stack on a platform that can be lifted by operation of an elevator, performing the media process in response to feeding a sheet at a time thereto, sensing the top of the stack to detect presence or absence of the stack at the media home position, sensing the top of the stack to detect presence or absence of the stack on the platform, sensing the platform to detect the presence or absence of the platform at a maximum elevated level, and indexing the stack at least once by lifting the platform through a predetermined distance through operation of the elevator, during performing the media process and not during picking a sheet one at a time from the top of the stack, unless the presence of the top of the stack at the media home position is sensed or the absence of the stack on the platform is sensed or the presence of the platform at the maximum elevator level is sensed. The indexing occurs in one of two ways: one, counting a predetermined number of sheets picked from the stack and fed to the media process; or, two, a combination of sensing the presence of the stack below the media home position, sensing the presence of media sheets on the elevator platform and sensing the absence of the elevator platform at the maximum elevator level. In an exemplary embodiment, the indexing occurs during a predetermined time interval after sensing passthrough of a sheet to feedthrough rolls from the pick mechanism in preparation to the performing the media process on the sheet and before the next pick page command is received by the input tray.

BRIEF DESCRIPTION OF THE DRAWINGS

Figure 1:
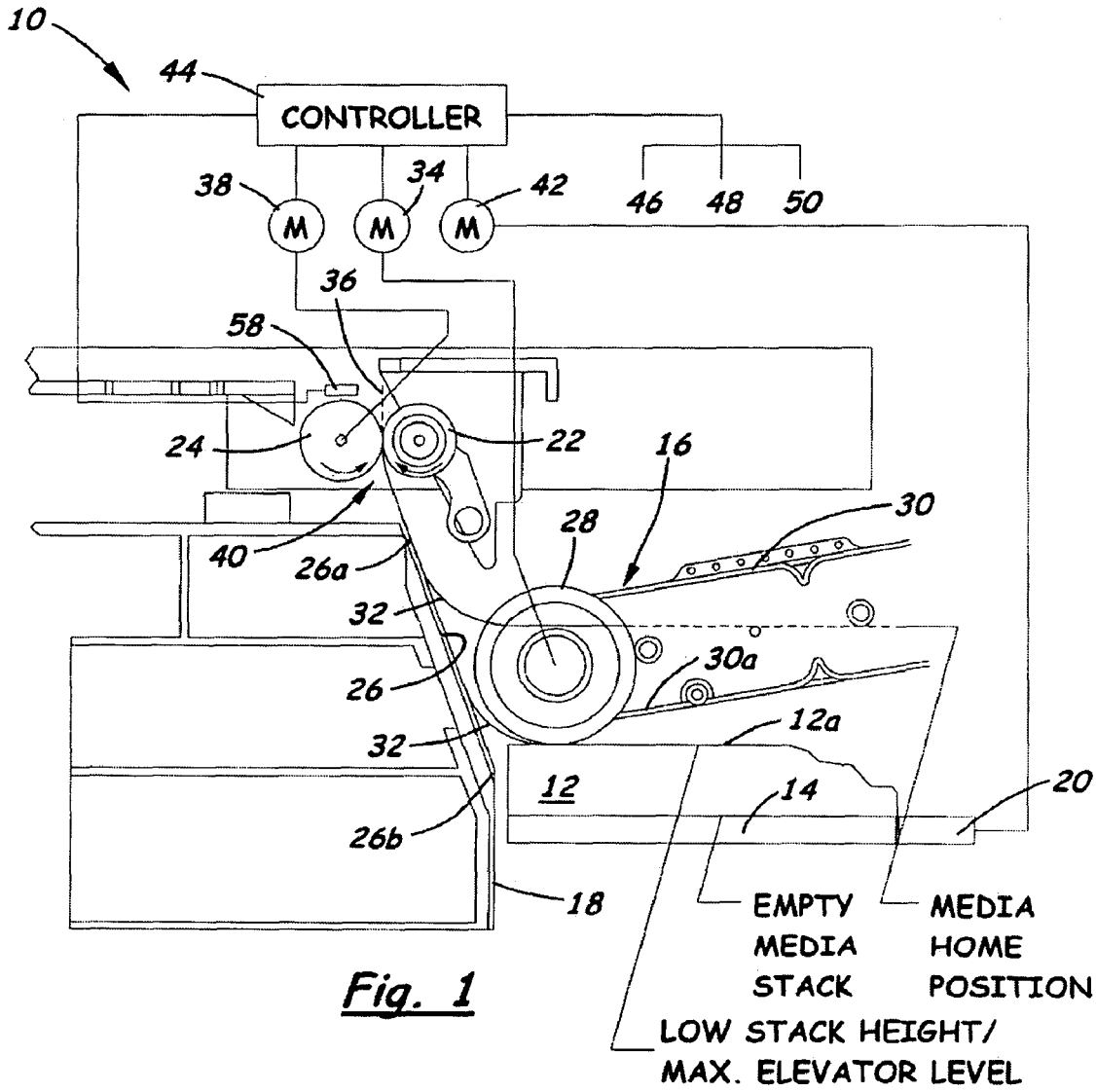

Having thus described the invention in general terms, reference will now be made to the accompanying drawings, which are not necessarily drawn to scale, and wherein:

FIG. 1 is a side elevational view of an exemplary of a pick mechanism, dam, platform, elevator and feedthrough rolls of a media input tray of a high capacity media handling device adapted to operate in accordance with a method of the present invention for dynamically lifting the elevator during an ongoing media process.

Figure 2:
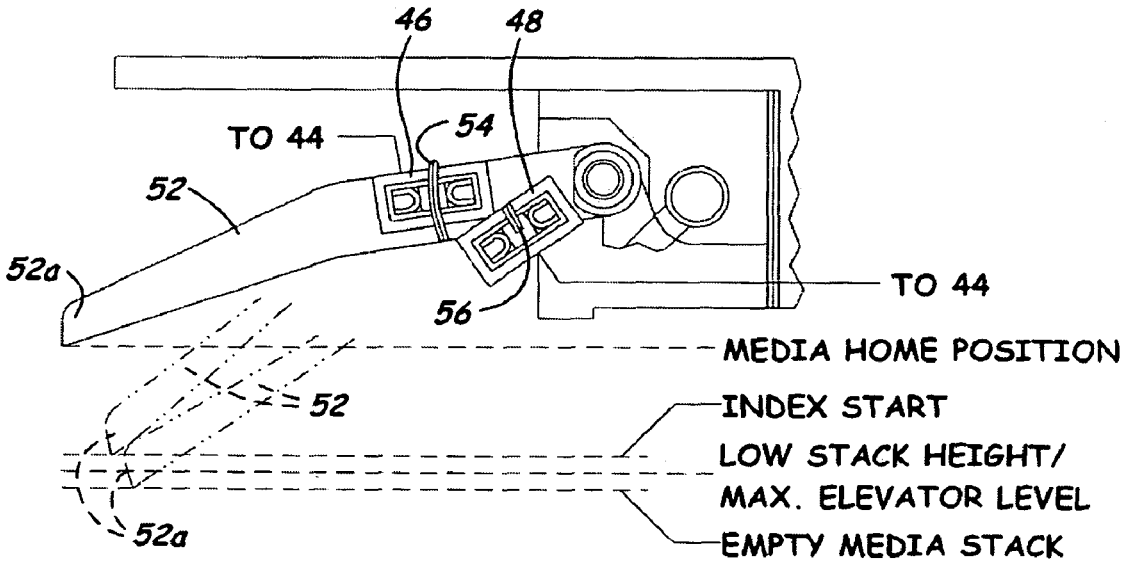

FIG. 2 is a side elevational view of an exemplary embodiment of a flag which contacts a top of a media stack on the platform of FIG. 1 and whose position is changed in response to change in the level of the top of the stack on the platform and of a pair of sensors of the input tray actuated by the flag which in combination with one another and a third sensor detects various positions of the top of the stack and platform and also determines in response thereto when indexing of the stack is commenced and terminated.

Figure 3:
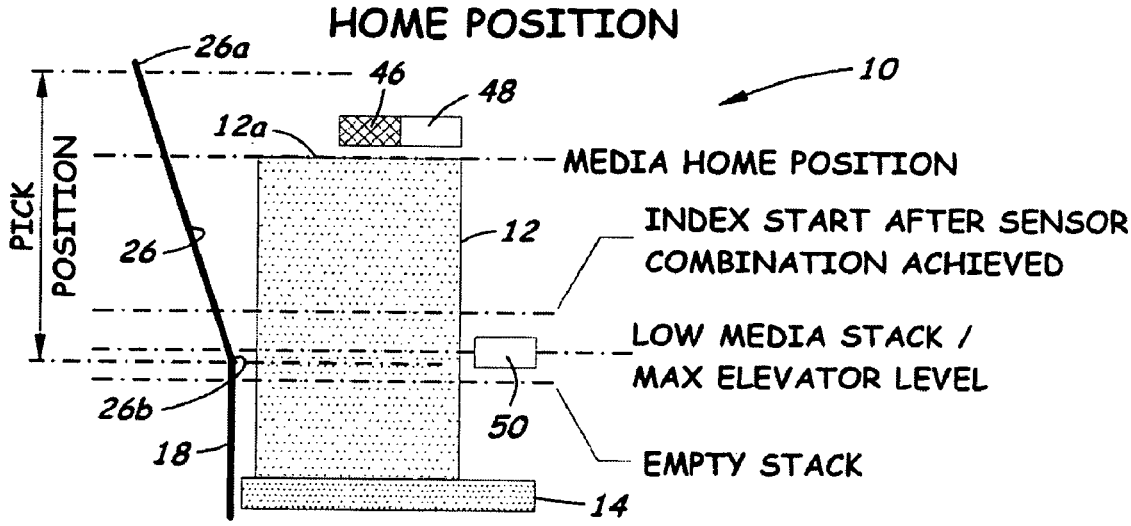

FIG. 3 is a schematic diagram of the media input tray at a home position.

Figure 4:
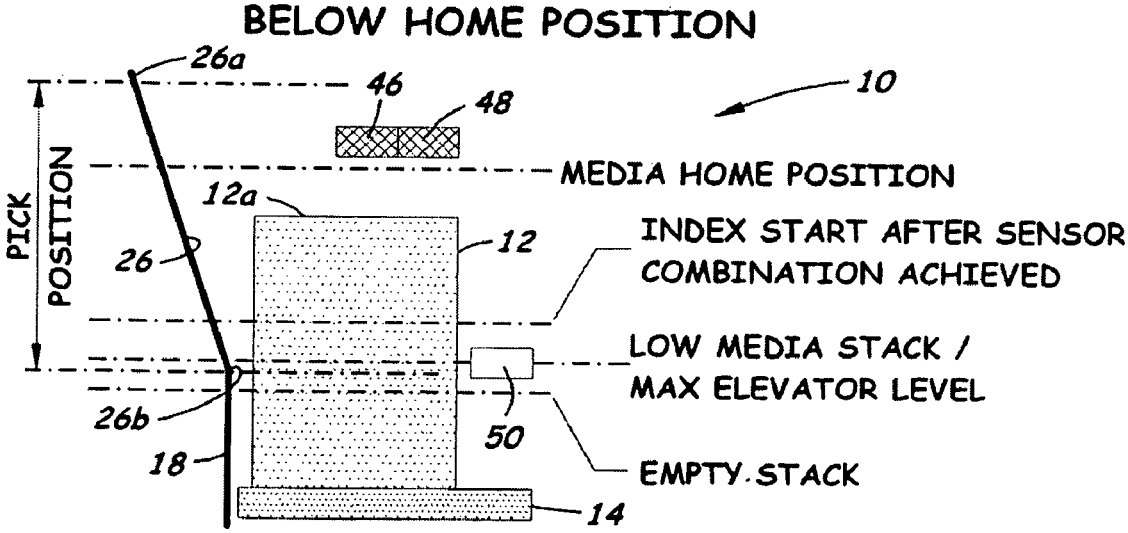

FIG. 4 is a schematic diagram of the media input tray at a below home position.

Figure 5:
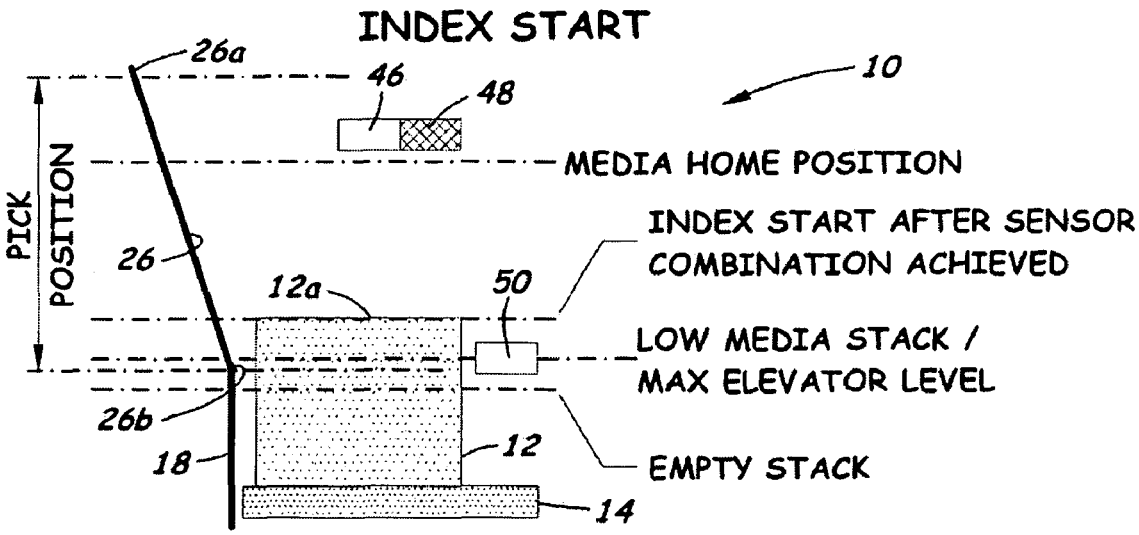

FIG. 5 is a schematic diagram of the media input tray at an index start position.

Figure 6:
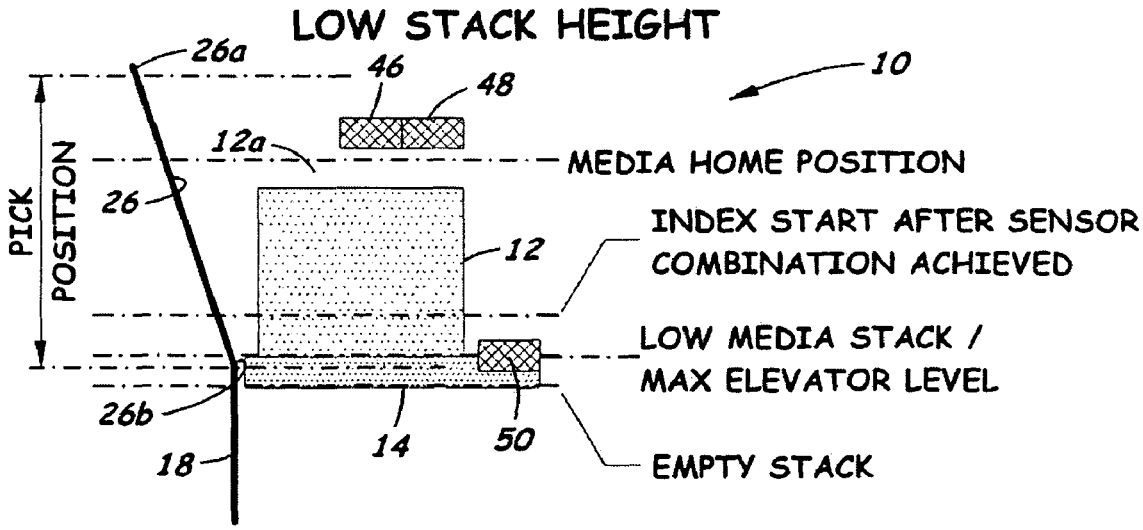

FIG. 6 is a schematic diagram of the media input tray at a low stack height position.

Figure 7:
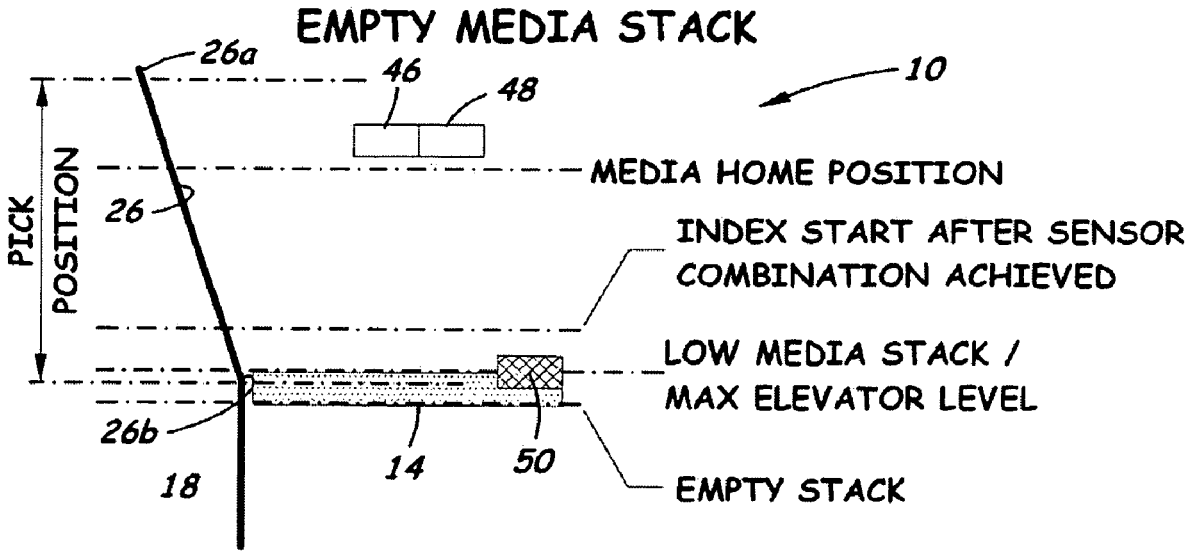

FIG. 7 is a schematic diagram of the media input tray at an empty media stack position.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Referring now to FIGS. 1 and 2, there is illustrated an exemplary embodiment of a media input tray, generally designated 10, of a high capacity media handling device. The input tray 10 is adapted to operate in accordance with the present invention to dynamically lift a stack 12 of media sheets during an ongoing media process, such as printing, copying or other conventionally well-known media processes. As well-known in the art, the input tray 10 includes a generally horizontal platform 14 on which the stack 12 of media sheets is loaded, a pick mechanism 16 operatively disposed above the platform 14, a restraint dam 18 disposed adjacent to and forwardly of the pick mechanism 16, an elevator 20 disposed below the platform 14 and drivingly coupled thereto and being operable for lifting and lower the same toward and away from the pick mechanism 16, and a pair of de-skew or feedthrough rolls 22, 24 disposed above and aligned with an inclined surface 26 of the restraint dam 18. The pick mechanism 16 has a pick roll 28 on an end 30*a* of an arm 30 pivotally mounted so as to maintain the pick roll 28 on the top most sheet 32 of the stack 12 of media sheets.

The pick roll 28 is driven by a motor 34 via a drive train (now shown) to rotate in a clockwise direction as depicted in FIG. 1 to move the top most sheet 12*a* out of the input tray 10 and into a media path 36 leading to the feedthrough rolls 22, 24. The one roll 24 is a drive roll powered by another motor 38 in a counterclockwise direction as depicted in FIG. 1 to receive the top most sheets 32 in an aligner nip 40 created by the contacting relationship of the drive roll 24 with the other roll 22 which is driven by the drive roll 24 to rotate in the opposite clockwise direction. The elevator 20 is powered by still another motor 42 to elevate or lift the platform 14 and thus the stack 12 thereon, in a manner in accordance with the present invention as will be described hereinafter, so as to present the top 12*a* of the stack 12 to the pick mechanism 16 at a level within a pick position which extends between the upper and lower ends 26*a*, 26*b* of the inclined surface 26 of the restraint dam 18. As described in U.S. Patent Application Publication No. 2007/0001369, which is assigned to the assignee of the subject application and whose disclosure is hereby incorporated by reference, the motors 34, 38, 42 may be D.C. motors operatively connected to a controller 44. The motors may have encoders (not shown) associated therewith that are monitored by the controller 44 to control and regulate the time and speed of operation of the motors. The controller 44 also may send pick and timing commands to drivers (not shown) for the motors establishing the timing and speeds for picking the media sheet 32 from the stack 12 to the aligner nip 40.

The above-described input tray 10 is adapted to operate in accordance with the method of the present invention for dynamically indexing the elevator platform 14 during the ongoing media process. For achieving such operation, the input tray 10 further includes three sensors 46, 48, 50, for example in the form of photo-interrupters or other electro-mechanical switches, which are used for stack height detection and elevator control and are connected to the controller 44. First and second sensors 46, 48 are actuated by a flag 52 which is triggered by the change in elevation of the top of the media stack 12. By way of illustration only, the flag 52 may be a mechanical device which influences the state of the sensors 46, 48. For example, the flag 52 may have first and second elements 54, 56 which act as shutters which switch, via blocking and non-blocking of, the sensors 46, 48 between off and on states by virtue of the pivotal position of the flag 52 in response to the media stack height. In the illustrated example, the end 52*a* of the flag 52 rides on the top 12*a* of the stack 12. The third sensor 50 is actuated by the elevator platform 14, specifically, when the platform 14 is at its maximum elevated level. The input tray 10 also includes a fourth, or passthrough, sensor 58 which is positioned along the media path 36 downstream from the dam 18 and upstream from the aligner nip 40 defined between the rolls 22, 24. The passthrough sensor 58 detects passage of a sheet 32 and is connected to the controller 44 for signaling the controller 44 that control for feeding the sheet is already in the feedthrough rolls 22, 24.

There are two ways to control the elevator 20 to start indexing. In a first sensor setting to control the elevator 20, the first sensor 46 will detect the media home position, the second sensor 48 will detect the empty stack position and the third sensor 50 will detect the low stack height position/maximum elevator position of the platform 14. To start indexing the stack 12, a predetermined number of picked sheets 32 are first counted, for example, 150 sheets. The top 12*a* of the stack 12 should still be in a pick position along the inclined surface 26 of the dam 18 when the predetermined number of sheets picked to start indexing is reached. Different media types and weights should be considered in setting the predetermined number to start indexing. Ninety and twenty pound media, for example, will have different thicknesses. The predetermined count should not go beyond 25 mm. The thickest media the input tray 10 can feed should be the basis for the number of page or sheet counts fed to start indexing.

In a second sensor setting to control the elevator 20 operation, the controller 44 reads combinations of the sensors 46, 48, 50 to detect the media home position (see FIG. 3), the below home position (see FIG. 4), the index start position (see FIG. 5), the low stack position (see FIG. 6), and the empty media stack position (see FIG. 7). Only the low media stack or third sensor 50 is triggered by the elevator platform 16, unlike the first and second sensors 46, 48 which are actuated by the change in level of the top 12*a* of the media stack 12. As represented in FIG. 2, the first and second sensors 46, 48 are mounted in stationary positions around the axis A of pivotal movement of the arm-like flag 52 that rides at its end 52*a* on the top 12*a* of the stack 12. On a side of the flag 52 are two separate shutters 54, 56 that move with it and will block light through the two sensors 46, 48 depending upon the position of the flag 52 which is tracking the top 12*a* of the stack 12. The sequence in which the shutters 54, 56 block the sensors 46, 48 is a gray code: at media home position, where the top 12*a* of the stack 12 is at its highest level and is used to stop operation of the elevator 20, the first sensor 46 is blocked and the second sensor 48 is not blocked (logic is 1, 0), as indicated in FIG. 3; at the next or below home position, where the top 12*a* of the stack 12 is at a next lower level and the top 12*a* of the stack 12 is within its normal range, both sensors 46, 48 are blocked (logic is 1, 1), as indicated in FIG. 4; at the next or index start position, where the top 12*a* of the stack 12 is at a next lower level where the stack 12 is considered too low so the elevator 20 should start lifting the stack 12 back toward the top position of FIG. 3, the first sensor 46 is not blocked and the second sensor 48 is blocked (logic is 0, 1), as indicated in FIG. 5; finally, at the lowest level, the empty media stack position, neither first or second sensors 46, 48 are blocked (logic 0, 0), as indicated in FIG. 6.

A similar shutter element (not shown) is associated with the elevator platform 14 to actuate (not block) or de-actuate (block) the third sensor 50. The controller 44 recognizes the blocked states, as indicated by the cross-hatched ones of the boxes 46, 48, 50 representing the first, second and third sensors 46, 48, 50, as one's and their unblocked state, as represented by blank ones of the boxes 46, 48, 50, as zero's, as shown in the boxes in FIGS. 3-7. The controller 44 starts and stops the elevator motor 42 for operating the elevator 20 to lift or lower the platform 14 as desired in response to the various combinations of states of the sensors 46, 48, 50.

The following initial or starting conditions apply. The media should only be fed or picked in the pick position, which falls between the upper and lower ends 26*a*, 26*b* of the inclined surface 26 on the dam 18. Lifting the platform 14 using the elevator 20 and picking media sheets 32 using the pick mechanism 16 will not be done at the same time. Unlike previously, if the media in the stack 12 is already low, or at low stack height position (see FIG. 6), the elevator 20 will not be operated to raise the platform 14 further since this level is the maximum height the elevator 20 can reach. Doing this will utilize the whole range of the pick position between the upper and lower ends 26*a*, 26*b* of the dam 18 and thus preserve further the wear strip thereon.

After loading the stack 12 on the platform 14 and the top 12*a* of the stack 12 placed at the media home position is achieved (see FIG. 3), the input tray 10 is ready for the media process, such as printing, to proceed. When the controller 44 reaches the total predetermined sheet count (first sensor setting) or its equivalent media level (second sensor setting) as seen in FIG. 5, the input device 10 is ready for indexing the media stack 12. Indexing is a concept of lifting the elevator platform 14 by segments, batches or increments of distance while performing media processes, such as printing, until the media home position is reached. It may/will take a number of segments until the media home position is reached. Most importantly, indexing will have no effect on the inter-page gaps.

The mechanics for indexing will now be described. When the passthrough sensor 58 of the input tray 10 (see FIG. 1) is made or triggered and control for feeding the sheet 32 has passed to the feedthrough rolls 22, 24, it is now time to start indexing the elevator platform 14. The window for indexing is limited from the time the passthrough sensor 58 is made until the controller 44 senses the input tray 10 is ready for the next pick page command. This interval of time is termed feedthrough time. To eliminate the error of picking and lifting at the same time, a buffer or allowance for indexing should be put in place, termed index time, since the elevator motor 42 will still decelerate when it receives a stop command. The feedthrough time is defined as follows:

feedthrough time(ms)=(sheet length−pick distance)(1000)/(process speed)

index time(ms)=(feedthrough time)−(motor decel time)

where:

feedthrough time=time from passthrough sensor made to tray ready (ms)

page length=length of sheet being fed (mm)

pick distance=linear distance traveled by sheet up to passthrough sensor make (mm)

process speed=linear sheet speed in the system (mm/s)

motor decel time=motor deceleration time (ms)

index time=time required to index the elevator (ms)

There are three variables that are used in indexing: index time, index distance and index velocity. Index time is the time limit available to lift the elevator platform 14 during feedthrough. Index velocity is the rate of lifting the elevator platform 14 with respect to the index time. Index velocity can also be computed from the motor's revolution per minute (RPM). Index distance is the vertical height the elevator platform 14 is lifted during index.

index velocity(mm/s)=(motor RPM)(roll diameter mm)(π)/(gear ratio)(60)(sec/min)

where:

index velocity=rate of lifting the elevator (mm/s)

motor RPM=motor revolution within its specification (rev/min)

roll diameter=diameter of roll pulley lifting the elevator (mm)

gear ratio=ratio of gears from the motor pinion to the pulley roll index distance (mm)=(index velocity)(mm/s)(1000)/(index time)(ms)

Since indexing is limited to the time allowed to index and the rate for it to lift, index distance is the output of the system. The first, or media home position, sensor 46 is sensing the top 12*a* of the stack 12 the elevator 20 has lifted, which is dependent on stack height (distance). One index may not be enough to reach the media home position shown in FIG. 3. When the media home position is not reached and one index is traveled, such as seen in FIG. 4, the controller 44 will wait for the next pick page command from the printer. When the pick page command is received, the pick mechanism 16 of the input tray 10 will pick the sheet and then after the passthrough sensor 58 is made, another indexing will ensue. Indexing will continue until the media home position, shown in FIG. 3, is reached. There is no need to complete the index distance or index time when the media home position is reached. If after one index is traveled, and the media home position is not reached, and no pick page command is sent (after a timeout), the controller 44 of the input tray 10 will cause the platform 14 to be lifted by the elevator 20 until the media home position is reached. The rate for lifting will be the same as the index velocity but there are no time limitations to reach the media home position, since there is no feeding or picking of sheets occurring. If after a number of sheets are already fed, the page count (first sensor setting) or the media level to index (second sensor setting) is not yet achieved, and no more pick page command is sent by the controller 44, the input tray 10 may lift back to the media home position while the media process is already idle. When the platform 14 is at the maximum elevator position shown in both FIGS. 6 and 7 no indexing will take place.

To summarize, in the method of the present invention performed by the input tray 10, the steps include picking a sheet 32 at a time from the top 12*a* of the stack 12 of media sheets using the pick mechanism 16 to feed to a media process with the top 12*a* of the stack 12 initially at a media home position and the stack 12 on the platform 14 that can be lifted by operation of the elevator 20, performing the media process in response to feeding a sheet at a time thereto, sensing the top 12*a* of the stack 12 to detect presence or absence of the stack 12 at the media home position, sensing the top 12*a* of the stack 12 to detect presence or absence of the stack 12 on the platform 14, sensing the platform 14 to detect the presence or absence of the platform 14 at a maximum elevated level, and indexing the stack 12 at least once by lifting the platform 14 through a predetermined distance through operation of the elevator 20 during performing the media process and not during picking a sheet one at a time from the top 12*a* of the stack 12, unless the presence of the top 12*a* of the stack 12 at the media home position is sensed or the absence of the stack 12 on the platform 14 is sensed or the presence of the platform 14 at a maximum elevated level is sensed. The indexing occurs in one of two ways: counting a predetermined number of sheets picked from the stack 12 and fed to the media process; or, a combination of sensing the presence of the stack 12 below the media home position, sensing the presence of media sheets on the elevator platform 14 and sensing the absence of the elevator platform 14 at the maximum elevator level. The indexing occurs during a predetermined time interval after sensing passthrough of a sheet 32 to feedthrough rolls 22, 24 from the pick mechanism 16 in preparation to the performing the media process on the sheet 32 and before the next pick page command is received by the input tray 10.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A method for dynamically lifting an elevator of a media input tray during an ongoing media process, said method comprising:

picking a sheet at a time from a top of a stack of media sheets using a pick mechanism to feed to a media process with the top of the stack initially positioned approximate a media home position and the stack on a platform that can be lifted by operation of an elevator;

performing the media process in response to feeding a sheet at a time thereto;

sensing the top of the stack to detect presence or absence of the stack at the media home position;

sensing the top of the stack to detect presence or absence of the stack on the platform;

sensing the platform to detect presence or absence of the platform at a maximum elevator level; and indexing the stack at least once by lifting the platform through a predetermined distance, through operation of the elevator during performing the media process and not during picking a sheet one at a time from the top of the stack, unless the presence of the top of the stack at the media home position is sensed or the absence of the stack on the platform is sensed or the presence of the platform at the maximum elevator level is sensed, the predetermined distance being indexed is based on a combination of an index time, an index distance and an index velocity.

2. The method of claim 1 wherein said indexing occurs in response to counting a predetermined number of sheets picked from the stack and fed to the media process.

3. The method of claim 2 further comprising:

before commencement of performing the media process, initially loading the stack of media sheets on the platform.

4. The method of claim 3 further comprising:

after initially loading the stack on the platform, lifting the platform if the top of the stack is not, and until the top of the stack is, positioned approximate the media home position.

5. The method of claim 2 wherein said indexing occurs during a predetermined interval of time after sensing passthrough of a sheet to feedthrough rolls from said pick mechanism in preparation to said performing the media process on the sheet.

6. The method of claim 5 wherein said predetermined interval of time ends in response to sensing a pick page command that said pick mechanism is ready for picking another sheet from the top of the stack.

7. The method of claim 6 wherein said indexing reoccurs during subsequent periods of time until the presence of the top of the stack at the media home position is sensed.

8. The method of claim 6 wherein said indexing resumes after a set timeout in response to sensing that no pick page command is received by said pick mechanism.

9. The method of claim 1 wherein said indexing occurs in response to a combination of sensing the presence of the stack below the media home position, sensing the presence of media sheets on the elevator platform and sensing the absence of the elevator platform at the maximum elevator level.

10. The method of claim 9 further comprising:

before commencement of performing the media process, initially loading the stack of media sheets on the platform.

11. The method of claim 10 further comprising:

after initially loading the stack on the platform, lifting the platform if the top of the stack is not, and until the top of the stack is, at the media home position.

12. The method of claim 9 wherein said indexing occurs during a predetermined interval of time after sensing passthrough of a sheet to feedthrough rolls from said pick mechanism in preparation to said performing the media process on the sheet.

13. The method of claim 12 wherein said predetermined interval of time ends in response to sensing a pick page command that said pick mechanism is ready for picking another sheet from the top of the stack.

14. The method of claim 13, wherein said indexing reoccurs during subsequent periods of time until the presence of the top of the stack at the media home position is sensed.

15. The method of claim 13 wherein said indexing resumes after a set timeout in response to sensing that no pick page command is received by said pick mechanism.

16. A method for dynamically lifting an elevator of a media input tray during an ongoing media process, said method comprising:

initially loading a stack of media sheets on a platform before commencement of performing a media process;

after initially loading the stack on the platform, lifting the platform if the top of the stack is not, and until the top of the stack is, at a media home position;

picking a sheet at a time from a top of the stack using a pick mechanism to feed to the media process;

performing a media process in response to feeding a sheet at a time thereto;

sensing the top of the stack to detect presence or absence of the top of the stack at the media home position;

sensing the top of the stack to detect presence or absence of the stack on the platform;

sensing the platform to detect presence or absence of the platform at a maximum elevator level; and indexing the stack at least once by lifting the platform through a predetermined distance through operation of the elevator during performing the media process and not during picking a sheet one at a time from the top of the stack, the predetermined distance being indexed is based on a combination of an index time, an index distance and an index velocity;

wherein the indexing occurs in one of two ways: counting a predetermined number of sheets picked from the stack and fed to the media process; or a combination of sensing the presence of the stack below the media home position, sensing the presence of media sheets on the elevator platform and sensing the absence of the elevator platform at the maximum elevator level.

17. The method of claim 16 wherein said indexing occurs during a predetermined interval of time after sensing passthrough of a sheet to feedthrough rolls from said pick mechanism in preparation to said performing the media process on the sheet.

18. The method of claim 17 wherein said predetermined interval of time ends in response to sensing a pick page command that said pick mechanism is ready for picking another sheet from the top of the stack.

19. The method of claim 18 wherein said indexing reoccurs during subsequent periods of time until the presence of the top of the stack at the media home position is sensed.

20. The method of claim 18 wherein said indexing resumes after a set timeout in response to sensing that no pick page command is received by said pick mechanism.

* * * * *